United States Patent [19]

Scherz

[11] Patent Number: 4,934,332

[45] Date of Patent: Jun. 19, 1990

[54] ARCHERY BOW PEEP SIGHT

[76] Inventor: Patrick L. Scherz, 1632-18½ Street, Rice Lake, Wis. 54868

[21] Appl. No.: 160,394

[22] Filed: Feb. 25, 1988

[51] Int. Cl.[5] ..... F41B 5/00

[52] U.S. Cl. ..... 124/87; 124/90; 33/265

[58] Field of Search ..... 124/86, 87, 90, 1, 24 R; 33/265

[56] References Cited

U.S. PATENT DOCUMENTS

| | | | |
|---|---|---|---|
| 3,199,502 | 8/1965 | Stonecipher | 124/87 |
| 3,703,771 | 11/1972 | Saunders | 124/90 X |
| 3,849,733 | 1/1975 | Chesnick | 33/265 |
| 3,942,507 | 3/1976 | Opal | 124/87 |
| 4,011,853 | 3/1977 | Fletcher | 124/87 |
| 4,116,194 | 9/1978 | Topel | 124/87 |
| 4,454,857 | 6/1984 | Miller et al. | 124/87 |
| 4,552,121 | 11/1985 | Treaster | 124/87 |

*Primary Examiner*—Randolph A. Reese
*Assistant Examiner*—John Ricci
*Attorney, Agent, or Firm*—Carl E. Gulbrandsen

[57] ABSTRACT

An archery bow peep sight designed to be mounted horizontally in a multi-stranded bowstring such that the axis of the peep is the same as the line of the bowstring. The peep sight is disk shaped having three or more slots parallel to the axis of the peep and uniformly distributed about the periphery. The faces of the peep sight are parallel to one another and have opposing frustoconical surfaces which are penetrated at their apexes by the sighting hole or peep.

3 Claims, 2 Drawing Sheets

FIG. 1
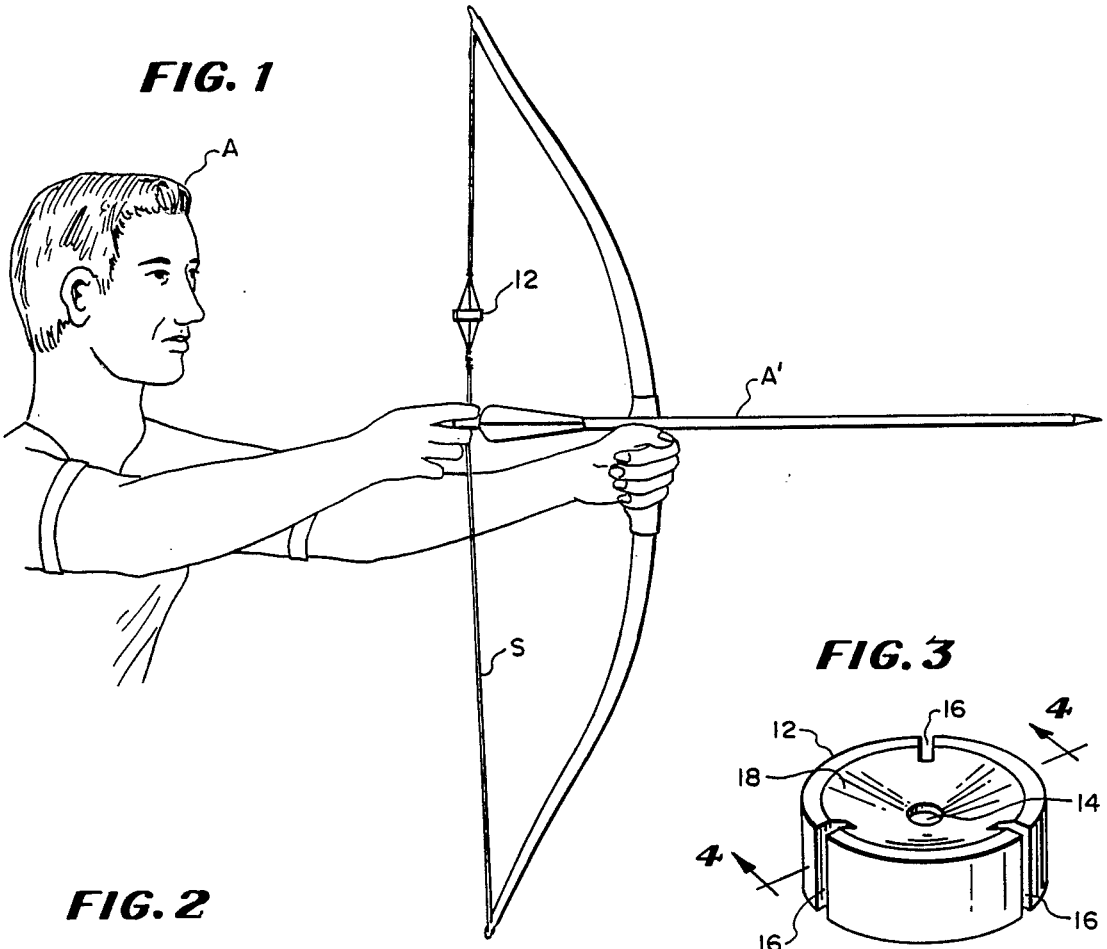
FIG. 3
FIG. 2
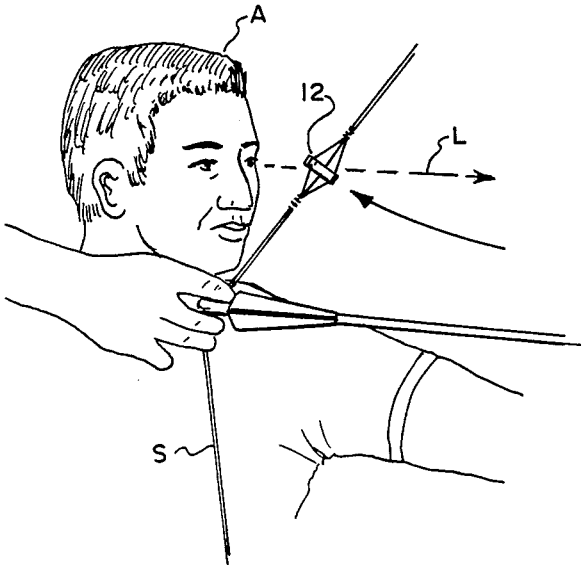
FIG. 4
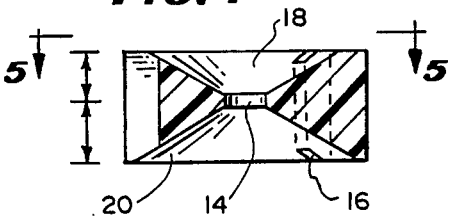
FIG. 5
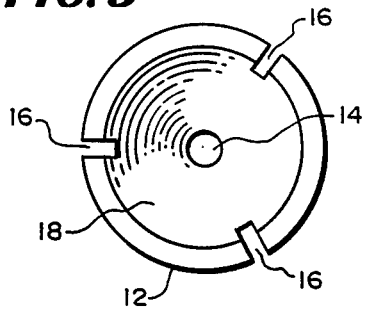

ARCHERY BOW PEEP SIGHT

FIELD OF THE INVENTION

This invention generally relates to an archery bow peep sight and specifically to an improved archery bow peep sight designed to be inserted horizontally into a multi-strand bowstring.

BACKGROUND OF THE INVENTION

It is convenient for an archer to be able to sight his shot using an archery bow peep sight. Commonly such peep sights are attached in some manner to the archery bowstring. When the string is drawn and cocked, the archer sights his target by looking through the peep to a needle sight mounted on the bow and then to the target.

The conventional peep sight is a disk having a sighting hole or peep and mounted vertically between the strands of a multi-strand bowstring. An example of such an archery peep sight is the Monster Hunting Peep manufactured by Gorman's Design of Minneapolis, Minn. Other types of vertically mounted peep sights are the No-serve Hunting Peep manufactured by Golden Key Futura, Montrose, Colo., and the peep sight disclosed in U.S. Pat. No. 3,703,771. A problem exists with the vertically mounted peep sights in that when the bowstring is drawn, the peep sight becomes rotated to a more horizontal plane and sighting through the peep becomes difficult and often impossible. Attempts to solve this problem resulted in the inventions described in U.S. Pat. Nos. 3,859,733; 4,011,853, and 4,116,194.

In U.S. Pat. No. 3,859,733, the sighting hole or peep is formed at an oblique angle relative to the plane of the disk. In U.S. Pat. No. 4,011,853, the peep sight itself is mounted in the bowstring at an oblique angle. And in U.S. Pat. No. 4,116,194 the sighting hole is formed at an oblique angle, and in addition an elastic cord attaches to the peep sight and the bow to assist in keeping the sight properly aligned. The peep sights described in these three patents present an improvement over the conventional vertically mounted peep sights, but only within a narrow range of the draw of the bowstring. If the bowstring is drawn too far or not far enough, sighting through these peep sights is difficult and in some cases impossible. Further, such peep sights are designed for use with bows of average length and stiffness. As the amount of draw required is affected by the stiffness and length of the bow, bows that depart from the average stiffness and length may require more or less draw than is necessary to be able to effectively use the aforementioned peep sights.

The present invention seeks to solve the above-mentioned problems. The archery bow peep sight hereafter described is designed to permit easy sighting through a wide range of draws of a bowstring. It is also suited for use with a variety of bow types, lengths and stiffnesses. Further, it is designed for easy attachment to a multi-strand bowstring with negligible effect on the movement of the bowstring. Finally, the invention is designed to permit ease and economy of manufacture.

SUMMARY OF THE INVENTION

The present invention is a disk shaped archery bow peep sight designed to be mounted horizontally in a multi-strand bowstring such that the axis of the peep is the same as the line of the bowstring. Three or more slots parallel to the axis of the peep are uniformly distributed about the periphery of the peep sight for receiving strands of the multi-strand bowstring. The faces of the peep sight of the present invention are parallel to one another and have opposing frusto-conical surfaces which are penetrated at their apexes by the sighting hole or peep.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only and is not intended as a definition of the limits of the invention.

BRIEF DESCRIPTION OF THE DRAWINGS

FIG. 1 is a side elevation view of the present invention archery peep sight mounted horizontally in a multi-strand bowstring illustrated in an undrawn position.

FIG. 2 is a side elevation view of the archery peep sight mounted horizontally in a multi-strand bowstring illustrated in a drawn and cocked position.

FIG. 3 is a pictorial view showing details of the archery peep sight.

FIG. 4 is a vertical cross-sectional view of the archery peep sight taken through line 4—4 of FIG. 3.

FIG. 5 is a top view of the archery peep sight illustrating a small diameter peep.

DESCRIPTION OF THE PRESENTLY PREFERRED EMBODIMENT

Figure 9:
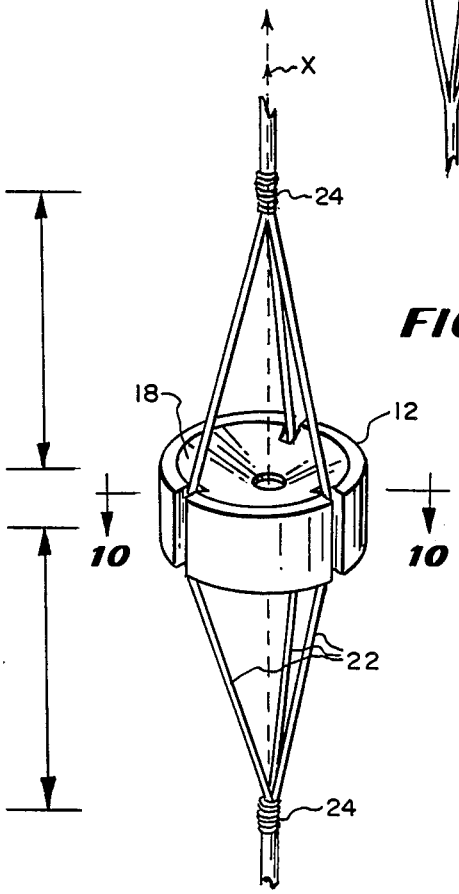
FIG. 9 is a pictorial view illustrating details of the archery peep sight mounted and secured within a multi-strand bowstring.

An understanding of the present invention can be readily gained by reference to FIG. 1 and FIG. 2 wherein side elevation views of the archery peep sight 12 mounted horizontally in a multi-strand bowstring S is shown. In FIG. 1 the archer has not yet begun to draw the bowstring and it can be seen that the line of the bowstring and the axis of the view hole or peep are the same, as can be best seen in FIG. 9. In FIG. 2 the archer has drawn the bowstring into the cocked position. It can be seen in FIG. 2 that as the bowstring is drawn, the archery peep sight is necessarily rotated upward in a clockwise direction such that it is rotated from the horizontal plane toward the vertical plane permitting the archer to sight through the sighting hole or peep. In the preferred embodiment a needle sight is affixed to the bow and sighting is accomplished by looking through the peep of the archery peep sight to the needle of the needle sight and thence to the target.

Figure 10:
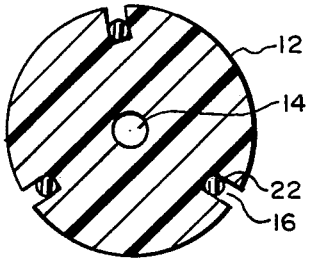
FIG. 10 is a horizontal cross-sectional view of the archery peep sight mounted within a multi-strand bowstring taken through line 10—10 of FIG. 9.

The archery peep sight 12 (FIG. 3) of the preferred embodiment is a disk formed from a medium soft plastic of the type referred to as Delrin, obtained from Eiler Co. 7140 Madison Ave., Golden Valley, Minn. 55427, although it can as easily be formed of many other types of material, for example nylon or aluminum. The archery peep sight 12 can be made many different sizes although the preferred embodiment is from $\frac{1}{4}$ to $\frac{5}{8}''$ diameter having a width of between 1/16" to $\frac{3}{8}''$. The archery peep sight has a sighting hole 14 which may vary in diameter from 1/16" to $\frac{1}{4}''$ depending on length of bow. The faces 18 and 20 (FIG. 4) of the archery peep sight are parallel and have opposing frusto-conical surfaces which are penetrated at their apexes by the sighting hole or peep 14. As can be further seen in FIG. 4, the frusto-conical surface of the top of the archery peep sight 18 is less deep than the opposing surface of the bottom of the archery peep sight 20. The walls of each frusto-conical surface have a 30 degree taper with the deeper cut at the bottom so that the deep side is toward the archer when the string is drawn, thus reducing problems caused by glare on bright days. FIG. 5 is a top view of the archery peep sight showing the center location of the sighting hole or peep 14 and the uniform distribution of slots 16 formed in the periphery of the peep sight. In the preferred embodiment, three slots 16 are formed in the periphery of the archery peep sight. These slots are designed to receive strands of the multi-strand bowstring, FIG. 10. For that purpose the slots may be of varying widths and depths but should be sufficiently large to accept snugly one-third of the strands in the multi-strand bowstring. In the preferred embodiment, the slots are formed between 0.020 inches in width, which is the approximate width of one strand, to approximately 0.050 inches in width, in which case several strands could lie side by side. As the archer must sight past the strands, a narrow width is preferred. In the preferred embodiment the depth of the slots is approximately 0.050 inches. As can be seen comparing FIG. 4 and FIG. 5, the sighting hole or peep 14 may be of varying diameters depending on the length of bow used and the purpose for which the peep sight is needed. If a longer than average bow is used, a sighting hole of larger diameter (FIG. 5) is preferred. Where extreme accuracy of sighting is required, a smaller diameter sighting hole FIG. 4 is preferred.

Figure 6:
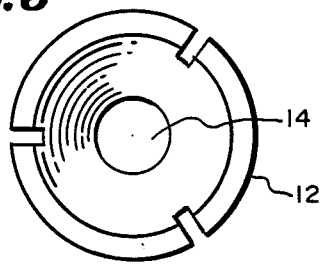
FIG. 6 is a top view of the archery peep sight illustrating a large diameter peep.
Figure 7:
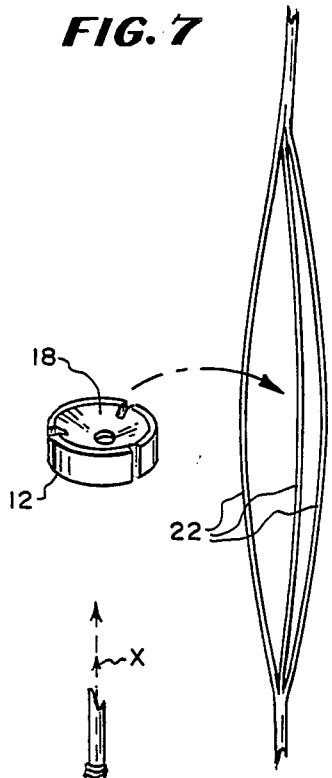
FIG. 7 is a pictorial view illustrating insertion of the archery peep sight into a multi-strand bowstring.
Figure 8:
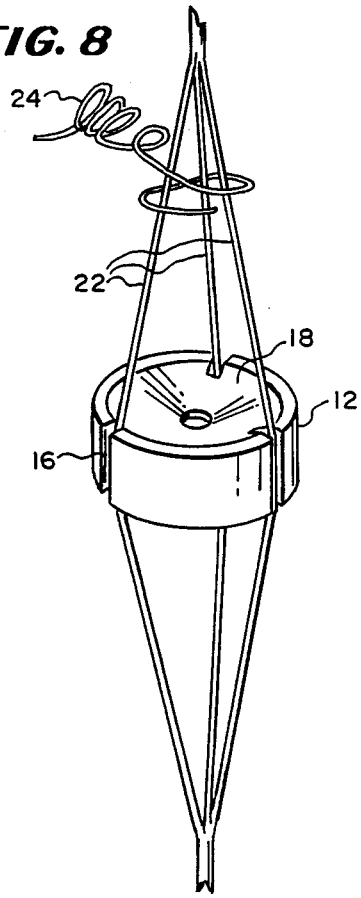
FIG. 8 is a pictorial view illustrating securing of the archery peep sight in the multi-strand bowstring.

The archery bow peep sight is mounted by inserting it into the multi-strand bowstring at a position that will keep it in line with the archer's eye when the bowstring is drawn and cocked, FIG. 2. At the appropriate position of the bowstring, the strands of the bowstring are divided into as many portions as there are slots to receive the strands, FIG. 7. In the preferred embodiment, three side slots are formed for receiving the bowstring strands. This arrangement is believed to provide stability and also ease of sighting as the archer will have to sight through the divided bowstring, FIG. 2. With divided portions of bowstring inserted into the slots, the archery bow peep sight is moved up or down for fine adjustment of positioning. When the final position is obtained, the archery bow peep sight is secured by serving with waxed string or similar material above and below the archery bow peep sight. Alternatively, it may be secured using nock sets or other devices.

The archery bow peep sight is designed for ease of manufacture. It may be machined on a lath or molded. In the preferred embodiment, the sight is formed from Delran which has the advantage of molding itself about the bowstring so that they become securely set. Delran has the further advantage of not chaffing the bowstring so as to cause premature wear.

What I claim is:

1. An archery bow peep sight, comprising: a disk having parallel faces with opposing frusto-conical surfaces, wherein one face of said disk has a frusto-conical surface which is deeper than the opposing face, a sighting hole penetrating said disk through the apexes of said frusto-conical surfaces, and a plurality of slots for receiving strands of a multi-strand bowstring, said slots distributed uniformly about the periphery of said disk and extending from said one face to said opposing face permitting horizontal insertion of said peep sight into said multi-strand bowstring.

2. An archery bow peep sight mounted horizontally in a multi-strand bowstring, comprising: a disk having a sighting hole the axis of which is aligned with the line of bowstring, said disk having bowstring strand receiving slots running parallel to the axis of said sighting hole and distributed uniformly about the periphery of said disk, said disk having parallel faces with opposing frusto-conical surfaces, the top said frusto-conical surface being less deep than the bottom said frusto-conical surface and the apex of said frusto-conical surfaces being penetrated by said sighting hole.

3. An archery bow peep sight, comprising: a disk mounted horizontally in a multi-strand bowstring; said disk having a sighting hole the axis of which is the same as the line of said bowstring; said disk having bowstring strand receiving slots running parallel to the axis of said sighting hole and distributed uniformly about the periphery of said disk; and said disk having parallel faces with opposing frusto-conical surfaces, the top said frusto-conical surface being less deep than the opposing bottom said frusto-conical surface, the apex of said frusto-conical surfaces being penetrated by said sighting hole.

* * * * *